US006621073B1

(12) United States Patent
Dresch

(10) Patent No.: US 6,621,073 B1
(45) **Date of Patent: *Sep. 16, 2003**

(54) TIME-OF-FLIGHT MASS SPECTROMETER WITH FIRST AND SECOND ORDER LONGITUDINAL FOCUSING

(75) Inventor: Thomas Dresch, Cambridge, MA (US)

(73) Assignee: Analytica of Branford, Inc., Branford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/689,309

(22) Filed: Oct. 12, 2000

Related U.S. Application Data

(63) Continuation of application No. 09/246,657, filed on Feb. 5, 1999, now abandoned, which is a continuation of application No. 08/887,615, filed on Jul. 3, 1997, now Pat. No. 5,869,829.

(60) Provisional application No. 60/021,184, filed on Jul. 3, 1996.

(51) Int. Cl.[7] ..... H01J 49/40

(52) U.S. Cl. ..... 250/287; 250/282

(58) Field of Search ..... 250/287, 282

(56) References Cited

U.S. PATENT DOCUMENTS 4,072,862 A * 2/1978 Mamyrin et al. ..... 250/286
5,032,722 A * 7/1991 Boesl et al. ..... 250/287
5,869,829 A * 2/1999 Dresch ..... 250/287

* cited by examiner

*Primary Examiner*—Jack Berman
(74) *Attorney, Agent, or Firm*—Levisohn, Lerner, Berger & Langsam, LLP

(57) ABSTRACT

A Time-of-Flight Mass Spectrometer (TOF-MS) is configured to improve resolution and sensitivity performance. The TOF-MS includes an arrangement of electrodes comprising an ion accelerator with two stages of homogeneous electric fields, an ion reflector with a single stage of a homogeneous electric field, accelerator and reflector being separated by a first drift space, and an ion detector which is separated from the reflector by a second drift space. Contrary to known TOF-MS of similar configuration, the set of electric potentials which must be applied to said electrodes is predetermined for a given geometry in such a way that a spatial distribution of ions initially at rest in the first gap of the said accelerator is compressed at the location of the detector in the longitudinal direction to a focus of first and second order in the initial axial coordinate. Therefore, mass resolution is enhanced over a TOF-MS that provides only for longitudinal focusing of first order, while the number of passages through grid electrodes along the flight path is reduced, and hence ion transmission and instrument sensitivity are improved.

6 Claims, 6 Drawing Sheets

TIME-OF-FLIGHT MASS SPECTROMETER WITH FIRST AND SECOND ORDER LONGITUDINAL FOCUSING

RELATED APPLICATIONS

The present application is a continuation of U.S. patent application Ser. No. 09/246,657 filed Feb. 5, 1999 now abandoned, which is a continuation of U.S. patent application Ser. No. 08/887,615 filed Jul. 3, 1997 (issued as U.S. Pat. No. 5,869,829 on Feb. 9, 1999), which claims the priority of U.S. Provisional Patent Application Serial No. 60/021,184 filed Jul. 3, 1996. All of those applications are fully incorporated herein by reference, and all rights of priority to those prior applications are claimed herein.

FIELD OF THE INVENTION

The invention relates to Time-of-Flight Mass Spectrometers that comprise a two stage ion accelerator, a one stage ion reflector, and first and second drift spaces. It provides a method that allows one to achieve a longitudinal compression of an initially spatially distributed package of ions, said compression minimizing the width of the ion package at the location of the ion detector to first and second order in the axial or longitudinal spatial coordinate.

BACKGROUND OF THE INVENTION

In a Time-of-Flight Mass Spectrometer (TOF-MS) it is advantageous if the ions of a specific mass to charge ratio are accelerated by means of suitable electric fields in such a way that their initial distribution in space is compressed to a thin sheet at the location of the ion detector. The larger initial package contains more ions, while the thin sheets of ions with different mass to charge ratios become well separated, hence sensitivity and resolution are enhanced.

It is taught by Wiley and U.S. Pat. No. 2,685,035 that such a compression can be facilitated by a linear TOF-MS comprising an ion accelerator with one or two stages of homogeneous electric fields, and a drift space which is terminated by the ion detector. Ions that start from a position further back in the accelerator of such a TOF-MS gain more kinetic energy and catch up with those ions that started from a point further forward in the accelerator when they reach the end of the drift space. The compression of the initial spatial distribution in the direction of the axial or longitudinal coordinate is called space focusing or longitudinal focusing.

The focusing achieved by the linear instrument of U.S. Pat. No. 2,685,035 is of first order in the initial longitudinal coordinate, which means, that the flight time is only a quadratic function of the starting position with a minimum or maximum for the middle or reference position. It was found, however, that the mass resolution that can be realized with a linear TOF-MS is limited by the fact, that the ions are not initially at rest but have an initial positive or negative velocity components in the acceleration direction, which results in a dispersion of the ion packages.

Ion reflectors are devices, that can turn around the direction of motion of ions by means of electric fields. Ions penetrate into these fields according to their velocity or energy component in the direction of the reflector field. Ions with higher kinetic energy penetrate deeper and need more time to pass through the reflector. It is therefore possible to achieve energy focusing, which means that the flight times of ions of one mass to charge ratio become largely independent of their initial axial energy.

Traditionally, a high resolution Reflector-TOF-MS is set up in the following way: At first, a primary longitudinal focus is formed close to the beginning of a field free drift space by means of an accelerator with one or to stages. The ions form a thin sheet at the primary longitudinal focus, but have a substantial distribution of axial energies reflecting mainly their different starting position. Then, this primary longitudinal focus is transferred to a secondary longitudinal focus at the location of the ion detector by means of the ion reflector. Ideally, the with of the ion package at the primary focal point is preserved, while the flight path is extended, hence the mass resolution can be higher in a Reflector-TOF-MS.

In a typical system as it was described e.g. by Mamyrin in U.S. Pat. No. 4,072,862, the ion accelerator merely acts as the input stage to the reflector. The geometrical dimensions and the electrical potentials that are required to achieve the primary and secondary longitudinal focus are set up separately for accelerator and reflector, while the individual parts of the Reflector-TOF-MS are connected by the common primary focus.

This route of designing a high resolution Reflector-TOF-MS was modified e.g. by Leisner, who described a TOF-MS comprising a to stage ion accelerator and a to stage ion reflector, which achieved a conceptual longitudinal focusing of first, second and third order. Here, all the electric potentials were determined directly from the equation for the total flight time and the longitudinal focusing conditions.

The two stage Mamyrin ion reflector with homogeneous electric fields provides energy focusing of first and second order, and thus facilitates the highly undistorted transfer of an ion package from the primary to the secondary longitudinal focus. In the design of Leisner a Mamyrin-reflector was used to allow for complete third order space focus at the location of the detector. However, it has the disadvantage, that ions must pass through the meshes of the reflector four times. These meshes reduce the ion transmission and hence the sensitivity of the instrument. They also reduce the mass resolution of the instrument due to scattering of the ions (Bergmann).

On the other hand, the energy focusing boundary condition for a single stage ion reflector requires, that the total field free drift space between the primary and secondary longitudinal focus is four times as long as the mean penetration depth of the ions into the reflector. This results in rather long reflectors, whenever a long flight path is required for high mass resolution. Furthermore, the energy focusing achieved with a single stage mirror is only of first order, thus transfer of the primary focus is less perfect and the overall mass resolution that can be achieved in the conventional way is limited. Ions pass through a single mesh twice on entering and leaving the a single stage reflector. This reduces the ion losses due to scattering, resulting in improved sensitivity when compared to a two stage reflector.

SUMMARY OF THE INVENTION

Accordingly, it is the object of the invention to improve the design of a TOF-MS to achieve improved resolution and sensitivity performance. This object is achieved, according to the invention, by an arrangement of electrodes comprising an ion accelerator with to stages of homogeneous electric fields, an ion reflector with a single stage of a homogeneous electric field, accelerator and reflector being separated by a first drift space, and an ion detector which is separated from the reflector by a second drift space. Contrary to known TOF-MS of similar configuration, the set of electric potentials which must be applied to said electrodes is predetermined for a given geometry in such a way, that a spatial distribution of ions initially at rest in the first gap of the said accelerator, is compressed at the location of the detector in the longitudinal direction to a focus of first and second order in the initial axial coordinate. Therefore, mass resolution is enhanced over a TOF-MS that provides only for longitudinal focusing of first order, Mile the number of passages through grid electrodes along the flight path is reduced, and hence ion transmission and instrument sensitivity are improved.

DESCRIPTION OF THE INVENTION

Figure 1:
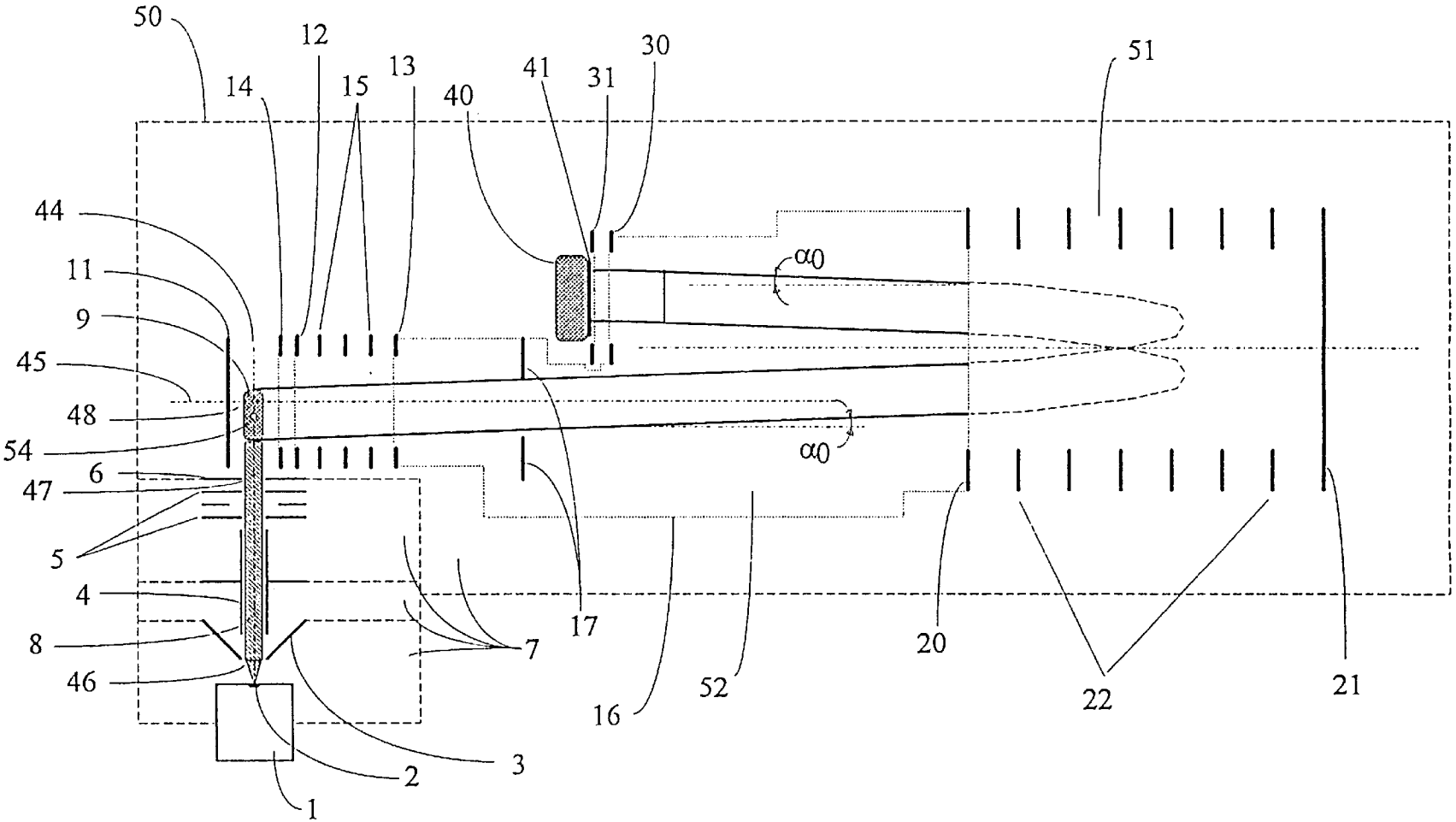
FIG. 1: Schematic of a TOF-MS according to the invention.

FIG. 1 shows schematically an embodiment of the invention. The TOF-MS diagrammed in FIG. 1 comprises a two stage accelerator, a first drift space, a single stage reflector, a second drift space, an additional post acceleration stage, and an ion detector. All electrodes of the TOF-MS and the detector surface are aligned parallel and perpendicular to the direction of the TOF instrument axis 45, which is defined by the direction normal to the surface and through the center of the accelerator electrodes. Accelerator, reflector, and post accelerator regions have homogeneous electric fields. In this embodiment the ion source and an ion transfer system are placed external to the TOF analyzer along the primary ion beam axis 44 which is orthogonal to axis 45.

Ions are generated in ion source 1 by means of a know ionization technique, and emerge from ion source 1 through orifice 2. The ion source type may be but is not limited to atmospheric pressure ion sources such as Electrospray (ES), Atmospheric Pressure Chemical Ionization Source (APCI), Inductively Coupled Plasma Source (ICP) or ion sources which produce ions in vacuum such as Fast Atom Bombardment (FAB), Electron Ionization (EI) or Chemical Ionization (CI). A portion of the ions exiting ion source 1 pass through orifice 46 of electrode 3. After passing through orifice 46 of electrode 3 the ions enter an ion guiding and focusing system. A favorable guiding system was described by Gulcicek, comprising a multipole ion guide ion guide 4, accelerating and focusing electrodes 5, shown here schematically as a 3-element lens, and exit aperture 6. The ion beam guiding system can include various means for steering, shaping and transporting ion beam 8 which are familiar to one skilled in the art. Such ion beam steering, shaping and transporting means may include split lens elements, RF only or DC quadrupole lens systems, parallel plate electrostatic deflectors, additional electrostatic lens sets or additional multipole ion guides. As it is further indicated in FIG. 1, one or more of the elements of the ion beam guiding system including elements 3, 4, 5 and 6 can also function as separation diaphragms in a differentially pumped vacuum system 7. Differential pumping provides an efficient and cost effective means to sequentially reduce the background pressure in the instrument.

Ions pass through orifice 47 in electrode 6 and move into the Time-Of-Flight Mass Spectrometer ion pulsing region 48 with kinetic energy $q^*U_i$ where q is the ion electrical charge and $U_i$ is the common accelerating electrical potential difference of the ion transfer system. The direction of motion of the ions emerging from orifice 47 is substantially in the direction of axis 44 which is orthogonal to axis 45 of the TOF-MS. This orthogonal component of motion is preserved when ions are accelerated into the Time-OF-Flight tube under acceleration by the homogeneous fields of the TOF-MS and causes the ions to drift sideways in the embodiment of FIG. 1, so that they reach the ion detector which displaced off axis 45 in the V shaped configuration of accelerator, reflector, and detector.

The method of orthogonal injection of externally generated ions into a Time-Of-Flight tube was demonstrated before by O'Halloran et. al. and was shown to have distinct advantages. The scope of the present invention, however, is not limited to this method. In other variants of the embodiment of the invention, ions can be generated inside the first stage of the accelerator, region 48, by any of the known ionization methods. These ionization methods may include but are not limited to Matrix Assisted Laser Desorption (MALDI), EI, CI or FAB. The ionization method such as MALDI or FAB may also include a delayed extraction step before ions are accelerated in the direction of TOF-MS axis 45. With these ionization methods, a V shaped ion flight configuration may be established by means of ion beam deflection or by means of a tilted reflector. In another embodiment, which utilizes an annular ion detector positioned along axis 45, the flight paths of the reflected ions essentially fold back on themselves.

The TOF-MS configuration diagrammed in FIG. 1 comprises a two stage ion accelerator which includes electrodes 11, 14, 12, 15 and 13, a first drift space between electrodes 13 and 20, a single stage ion reflector formed by electrodes 20, 22, and 21, a second drift space between electrodes 20 and 30, a post acceleration stage between electrodes 30 and 31, and an ion detector 40 with a flat conversion surface 41. The openings in electrodes 14, 12, 13, 20, and 30 are covered with fine metal grids to ensure homogeneous electric fields between the electrodes wile allowing high ion transmission.

The first stage of the ion accelerator electrode system is formed by repeller electrode 11 and mesh electrode 12. In the preferred embodiment shone in FIG. 1, an additional mesh electrode 14 can be placed between electrodes 11 and 12 in order to shield against electric fields penetrating through the mesh in electrode 12. In alternative embodiments, electrode 14 need not be included in the first stage of the ion accelerator. The electric potential applied to electrode 14 is intermediate to the potentials applied to electrodes 11 and 12 and is proportional to the distance from electrodes 11 and 12.

Ions from initial orthogonal ion beam 8 are admitted into the space between electrodes 11 and 14, while these electrodes are held at a common potential approximately equal to the potential of electrode 6. Then, by means of external switches electric potentials are applied to the accelerator electrodes 11, 14 and 12 that generate a homogeneous electric field between electrodes 11 and 12, which is oriented parallel to axis 45. This field between electrodes 11 and 12 accelerates the ions in region 48 between electrodes 11 and 12 in the direction of axis 45 towards electrode 12. During the ion accelerating period the field in region 48 effectively prevents additional ions in initial beam 8 from entering the first accelerator stage region 48. As soon as the ions have been accelerated out of accelerator region 48 between electrodes 11 and 12, the electric potentials applied to electrodes 11,14 and 12 can be reset to their original values, thus admitting new ions in orthogonal beam 8 into accelerator region 48 for a new cycle to begin.

A constant homogeneous electric field is maintained in the second stage of the accelerator between electrodes 12 and 13, which further accelerates the ions that pass from the first stage into the second stage through the mesh in electrode 12. In the preferred embodiment shown, guard electrodes 15 without meshes are placed between electrodes 12 and 13 to extend the length of the second accelerator stage, while maintaining a homogeneous electric field. Electrodes 15 are held at intermediate electrical potentials with values proportional to their distance along axis 45 from electrodes 12 and 13, e.g. by means of a resistive voltage divider network.

Front electrode 20, back electrode 21, and a series of guard electrodes 22 constitute ion reflector assembly 51. The electrical potential applied to electrode 20 is set at the same electrical potential as electrode 13. Guard electrodes 22 are held at intermediate potentials between 20 and 21 with values proportional to individual electrode distances from electrodes 20 and 21. In this manner a homogeneous electric field is maintained between electrodes 20 and 21, similar to guard electrodes 15. The homogenous electric field maintained in the space between 20 and 21 serves to reverse the longitudinal motion of ions.

Electrodes 30 and 31 form a post acceleration stage in front of the ion detector 40 with sensitive ion conversion surface 41. Electrode 30 is held at the same electrical potential as electrodes 13 and 20, whereas electrode 31 is held at a different potential, such that ions gain additional kinetic energy in the electric field between electrodes 30 and 31. This additional ion kinetic energy increases detection efficiency of ions impacting on detector surface 41. Detector surface 41 is held at the same potential as electrode 31 and may in fact be a coincident or part of this electrode.

In the embodiment shown in FIG. 1, one or more beam limiting apertures 17 are placed in the drift space to define the accepted shape of the ion package perpendicular to the axis 45 and to prevent stray ions from reaching the detector. Beam limiting apertures may or may not be included in alternative Time-Of-Flight tube embodiments.

A metallic shield electrode 16 encloses the drift spaces 52 between electrodes 13, 20, and 30. It is electrically connected with said electrodes in order to define potential in drift space 52 and to maintain the keep drift space 52 free from disturbing electric fringing fields. Preferentially the shield is perforated for effective evacuation of neutral gas from the enclosed space.

Components of the TOF-MS are placed in multiple pumping stage housing 50 that can be evacuated. The ion source and the transfer ion optic may be incorporated in the same housing or located in individual housings with different chambers that can be pumped differentially.

Basis of the Invention

Figure 3:
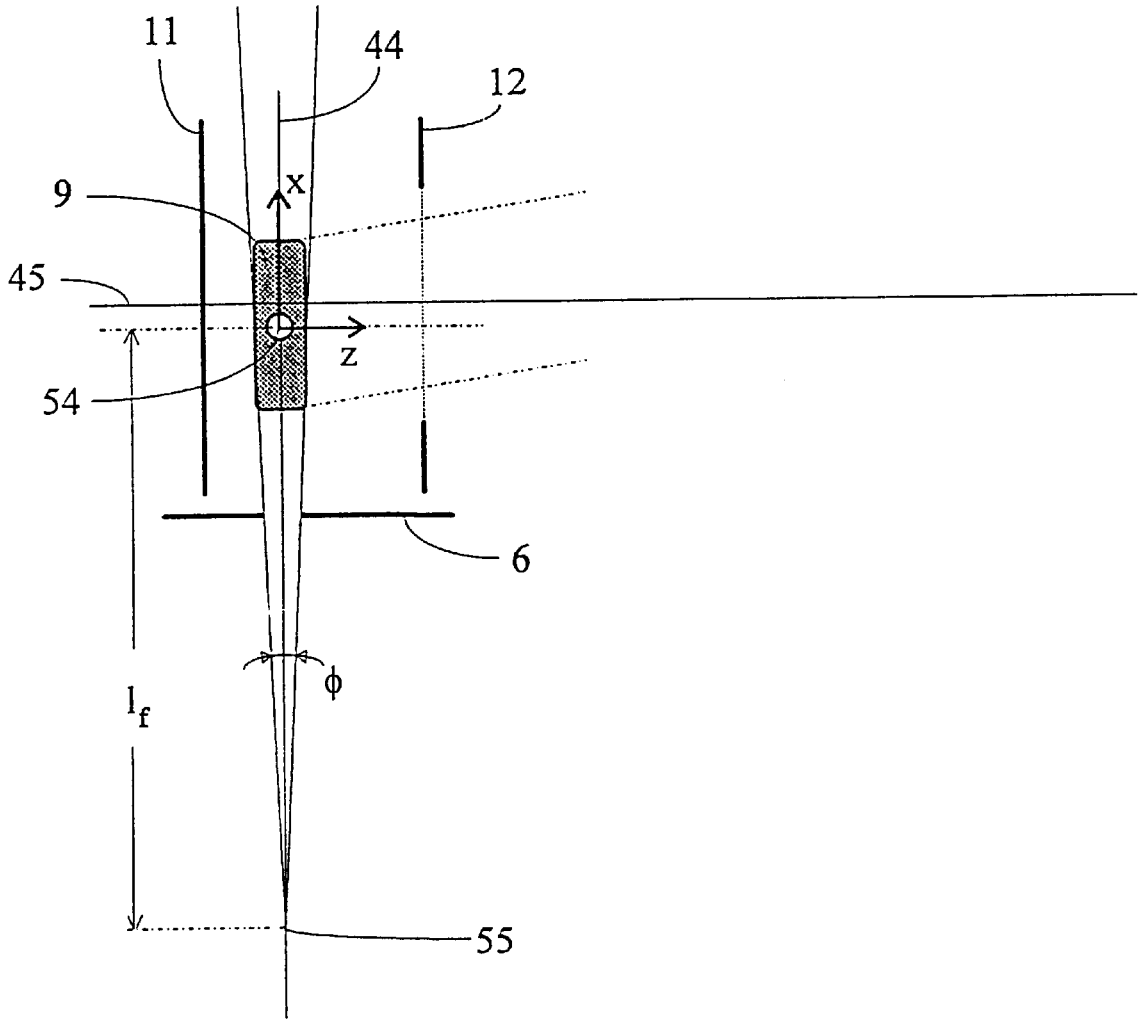
FIG. 3: Orthogonal injection of a divergent ion beam into the accelerator of a TOF-MS.

In order to fully describe the basis of the invention, let $d_1$ and $d_2$ be the length of the first and second accelerator stage, respectively. Referring to FIGS. 1 and 3, the distance from central reference point 54 of the ion packet 9 to electrode 12 shall be $f*d_1$, where f is a dimensionless fractional number between 0 and 1. The lengths of the first and second drift spaces, the first between electrodes 13 and 20 and the second between electrodes 20 and 30 are defined to be $d_{3A}$ and $d_{3B}$ respectively where the total axial drift length is then $d_3=d_{3A}+d_{3B}$. The depth of ion mirror or ion reflector 51, i.e. the distance between electrodes 20 and 21, shall be $d_4$, and the length of the post accelerator, that is the distance between electrodes 30 and 31 shall be $d_5$. For simplicity, surface 41 of ion detector 40 is made to be coincident with electrode 31, so that no additional drift space is has to be considered between electrode 31 and the surface 41.

The magnitude of the electric potential differences applied to the electrodes shall be expressed in reference to the potential difference $U_0$ that accelerates an ion which starts at a distance $f*d_1$ from electrode 12. Consequently, the electrical potential difference between electrodes 11 and 12 is $U_1=\alpha*U_0$; the potential difference between electrodes 12 and 13 is $U_2=\beta*U_0$; $U_4=\rho*U_0$ is the reflector potential difference between electrodes 20 and 21, and $U_5=\gamma*U_0$ is the post acceleration potential difference between electrodes 30 and 31. From the definition of $U_0$, $U_0$ can be expressed as $U_0=(f*\alpha+\beta)*U_0$ and hence $f*\alpha+\beta=1$.

Now, a dimensionless parameter k of order 1 is introduced to describe the initial position of an ion in axial direction as $k*f*d_1$. k=1 is the reference position, for k<1 an ion starts closer to electrode 12, for k>1 an ion starts closer to electrode 11. For later reference, a coordinate z in the direction of axis 45 is introduced: z=0 corresponds to the axial position k=1, positive values of z to values k<1 and negative values of z to values k>1.

With these definitions, and assuming no initial motion of the ions in axial direction, the total flight time of an ion from the first accelerator stage, region 48, to ion detector surface 41 is expressed as follows;

$$T(k)=\frac{1}{v_0}\left[\frac{2fd_1}{\alpha'}\sqrt{k\alpha'}+\frac{2d_2}{\beta}\left(\sqrt{k\alpha'+\beta}-\sqrt{k\alpha'}\right)+\frac{d_3}{\sqrt{k\alpha'+\beta}}+\frac{4d_4}{\rho}\sqrt{k\alpha'+\beta}+\frac{2d_5}{\gamma}\left(\sqrt{k\alpha'+\beta+\gamma}-\sqrt{k\alpha'+\beta}\right)\right]\alpha \quad (1)$$

Here, $\alpha'=f*\alpha$, $v_0=\sqrt{(2qU_0/m)}$ is the axial velocity component of an ion with mass m and charge q, that was accelerated by the reference potential difference $U_0$.

$T_0=T(k=1)$ is the total flight time of an ion that starts at the reference position k=1. $L_{eq}=T_0*v_0$ is the equivalent drift length of the TOF-MS, given by the expression in square brackets in Equation (1) for k=1. In the time $T_0$ an ion with initial orthogonal velocity $v_i=\sqrt{(2qU_i/m)}$ moves the distance $D=v_i*T_0=(v_i/v_0)*L_{eq}=L_{eq}\sqrt{(U_i/U_0)}$ in the direction perpendicular to axis 45. Distance D is independent of the ratio m/q, hence all ions drift the same distance perpendicular to axis 45 and reach the detector. The angle of an ion trajectory with axis 45 is given by the ratio of the velocity components in orthogonal and axial direction. In field free drift section 52 the angle is given by the relation $\tan\alpha_0=v_i/v_0=\sqrt{(U_i/U_0)}$.

Initially, the ions are spatially distributed in acceleration region 48, corresponding in axial direction to a range of starting position parameters k. It is now the principle of TOF-MS to make the flight time of any ion of a given m/q ratio independent of its starting position. In space, this means that the axial width of a packet of ions in first accelerator stage 48 is compressed into a thin sheet when it arrives at the detector surface.

Mathematically, the conditions for longitudinal focusing of first and second order are expressed by the derivatives of the flight time, Equation. (1), with respect to the position parameter k, taken at k=1;

$$\frac{\partial T(k)}{\partial k} = 0; \quad k = 1 \tag{2a}$$

$$\frac{\partial^2 T(k)}{\partial k^2} = 0; \quad k = 1 \tag{2b}$$

First, a TOF-MS without a post acceleration stage shall be considered. This is done in order to clearly state the principal of achieving longitudinal focusing of first and second order by means of a to stage accelerator and a single stage reflector. Setting $d_5=0$, $\gamma=0$ which eliminates the final term in the square brackets of Equation (1). Taking the geometric dimensions as constant input parameters, Equations (2a) and (2b) result in to equations for the two unknown independent variables $\alpha'$ and $\rho$. Eliminating $\rho$ from this set of equations leads to a condition for $\alpha'$.

The condition for the variable $\alpha'$ can be expressed as follows substituting $x=(1/\alpha')^{1/2}$;

$$F(x)=ax^7+bx^5+cx^3+dx^2+e=0 \tag{3a}$$

where: (3b)

$a=-fd_1$ $b=2fd_1+d_2$ $c=-(fd_1+d_2)$ $d=d_3$ $e=-d_3$

A solution for Equation (3) can be found by means of known numerical algorithms. Hence, the values of $\alpha'$ and $\rho$ can be determined which satisfy the conditions (2) for simultaneous first and second order longitudinal focusing.

Parameters of a TOF-MS According to the Invention

Table 1 summarizes the dimensions of one preferred embodiment of the TOF-MS conforming to the invention. It is obvious from the general nature of the described method that other dimensions can be chosen under the scope of the invention.

TABLE 1

| Dimensions of a TOF-MS conforming to the invention | |
|---|---|
| $d_1$ | 15 mm |
| f | 0.5 |
| $d_2$ | 20 mm |
| $d_{3A}$ | 400 mm |
| $d_{3B}$ | 200 mm |
| $d_4$ | 150 mm |
| $d_5$ | 0 mm |

By solving Equation 3 with the dimensions given in Table 1, one finds the relative potential differences $\alpha'$, hence $\alpha$ and $\beta$, and $\rho$. Subsequently, one determines from the above definitions the absolute electrical potential differences and the actual voltages that must be applied in order to achieve focusing of first and second order according to the invention.

The results are summarized in Table 2, column 2a, along with a number of quantities that characterize the TOF-MS. The length $L_{WM}$ is the distance of the primary longitudinal focus from the accelerator (Wiley/McLaren focus), factor p gives the relative penetration of the ions into the reflector. R is a parameter to express the theoretical mass resolution. It is defined as the ratio of the time $T_0$ to twice the width of the distribution of flight times $\Delta T$ that results from an initial spatial distribution between the boundaries $-\delta<z<+\delta$.

$$R = \frac{T_0}{2\cdot\Delta T} = \frac{T_0}{2[\max(T(z)) - \min(T(z))]}; \quad -\delta < z < +\delta \tag{4}$$

TABLE 2 a) Parameters of a TOF-MS according to the invention,
b) Comparison with a traditional TOF-MS of identical dimensions (Table 1) but with the primary longitudinal focus close to the accelerator.

Figure 2A:
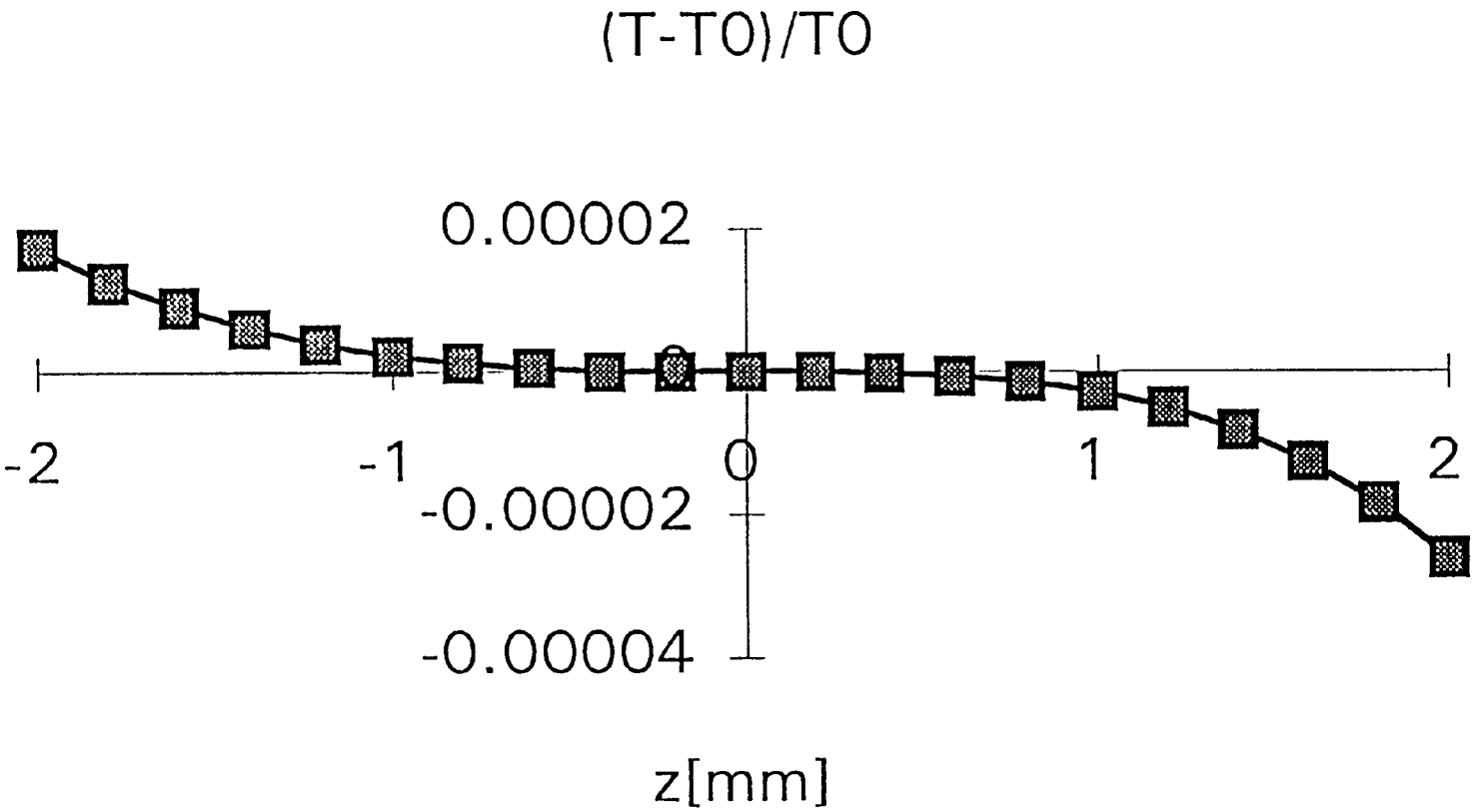
FIG. 2*a*: Relative flight times as a function of the initial axial position for the TOF-MS according to the invention. First and second order longitudinal focusing is achieved with the parameters of Table 1 and 2a). The resolution parameter of this configuration is R(+/−1 mm)=95101.
Figure 2B:
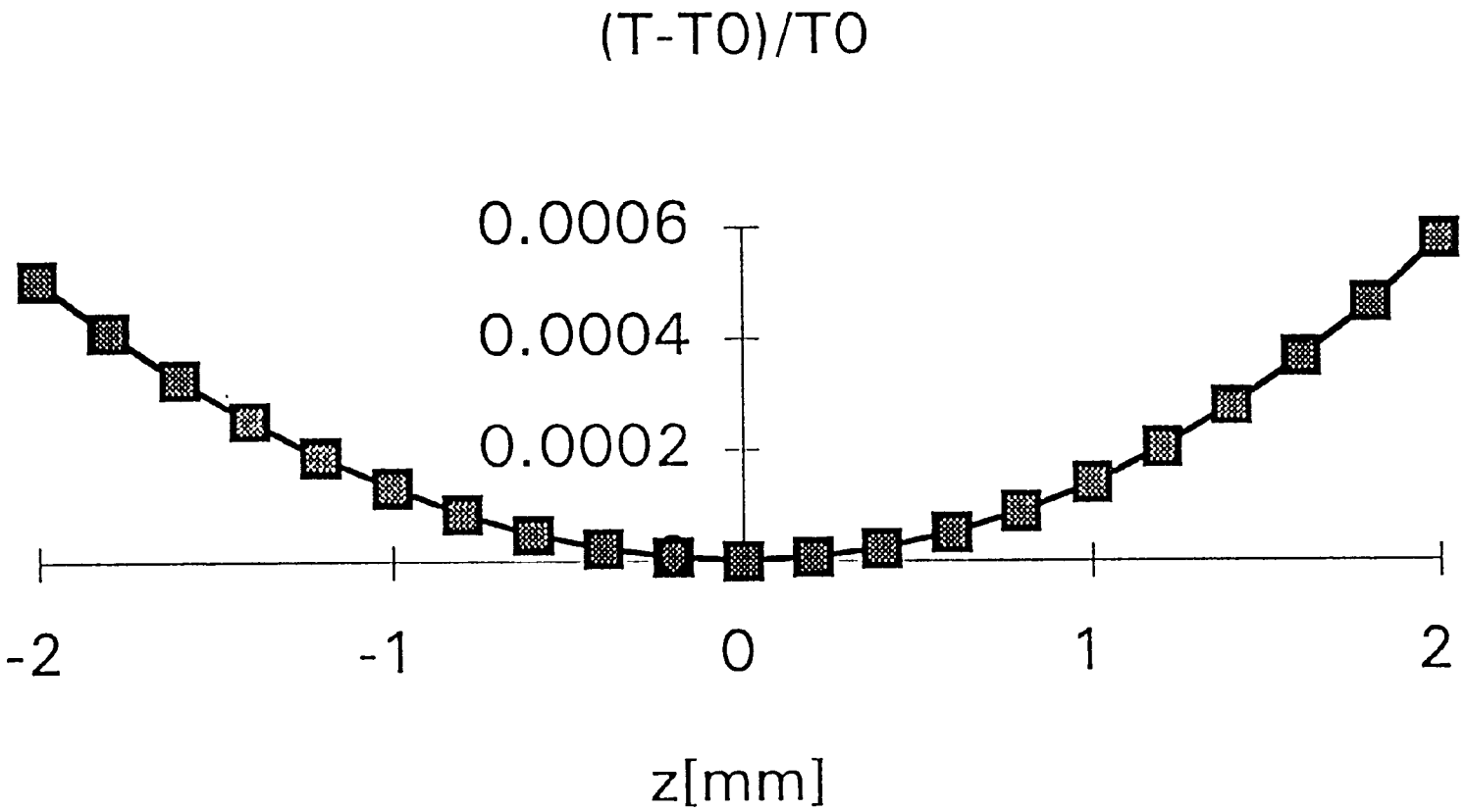
FIG. 2*b*: Traditional TOF-MS using the same dimensions as the TOF-MS according to the invention but set up in order to have the primary longitudinal focus close to the accelerator (see Table 2b). A first order longitudinal focus is achieved with a much smaller resolution parameter R(+/−1 mm)=3577.

| Parameter | a) new TOF, first and second order focus, FIG. 2a) | b) traditional TOF first order focus, FIG. 2b) | Units |
|---|---|---|---|
| $U_1$ | 673.33 | 1000.00 | V |
| $U_2$ | 2200.00 | 1500.00 | V |
| $U_4$ | 4110.80 | 2250.00 | V |
| $U_0$ | 2536.70 | 2000.00 | V |
| $L_{eq}$ | 1040.70 | 1190.00 | mm |
| $T_0$ (m/z = 560) | 35 | 45 | μs |
| p | 62 | 89 | % |
| $L_{WM}$ | 229.76 | 66.67 | mm |
| R (+/− 1 mm) | 95101 | 3577 | |

FIG. 2*a* shows the relative flight times as a function of the initial position, i.e. the ratio $(T(z)-T_0)/T_0$ as it is calculated from Equation (1) for the TOF-MS according to the invention using the geometrical and electrical parameters from Tables 1 and 2. The saddle point at z=0 (k=1) as shown in FIG. 2*a* is characteristic for the simultaneous focusing of first and second order. Consequently the resolution parameter assumes the high value of R=95,100 for starting positions −1 mm<z<+1 mm (+/−1 mm).

For comparison, Table 2, column 2b lists the parameters of a TOF-MS according to the conventional setup, which utilizes the identical geometrical configuration of Table 1. Here, the primary longitudinal focus is brought close to the accelerator by selecting suitable accelerator potentials. The reflector potential is then determined to transfer the primary focus onto the detector. It is evident from FIG. 2*b*, that the longitudinal focusing achieved with these parameters is of first order only. Consequently, the resolution parameter R for the same initial spatial distribution around z=0 is much lower.

Figure 2C:
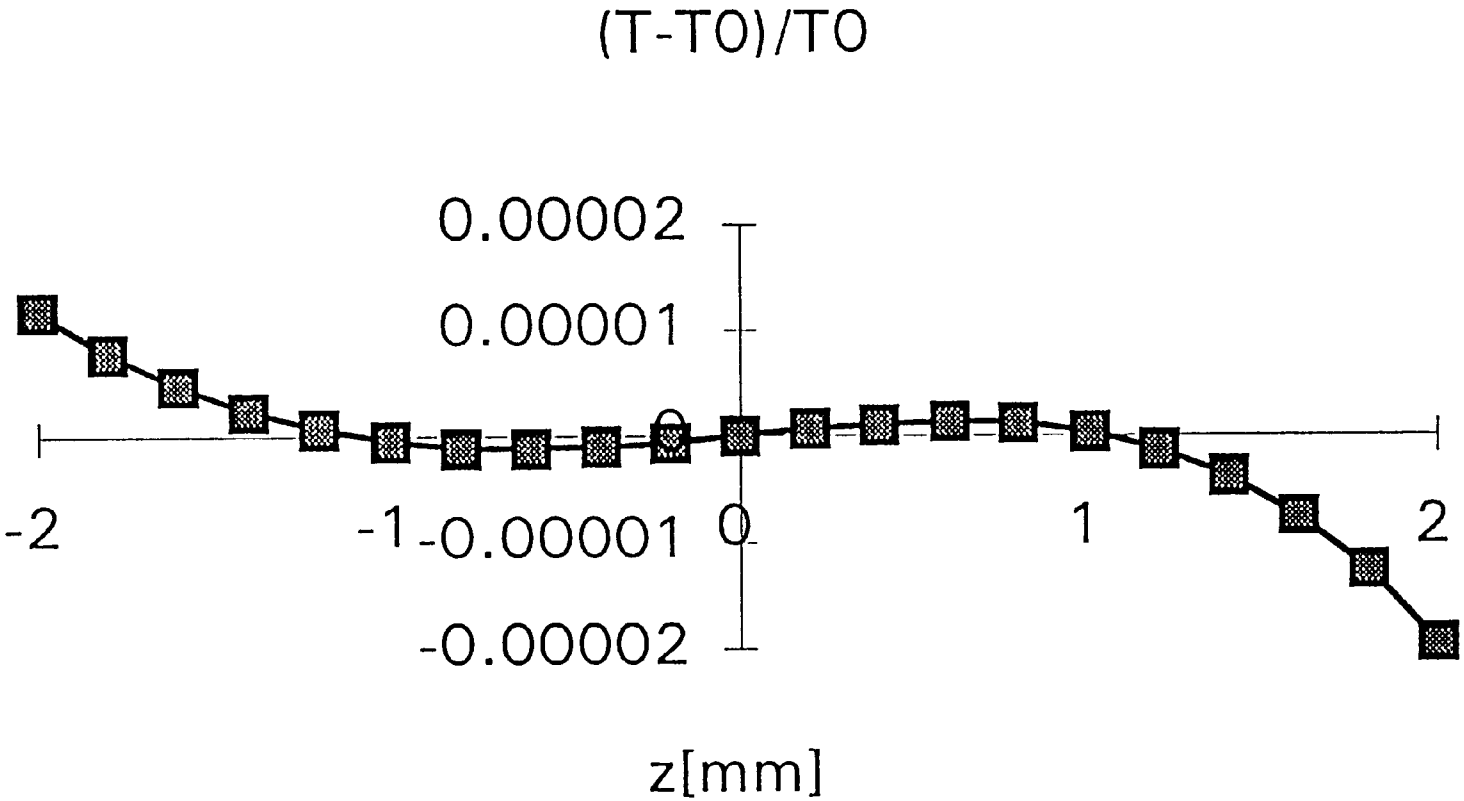
FIG. 2*c*: Adjustment of the potentials $U_1$, $U_2$, or $U_4$ results in an S shaped distribution of relative flight times; with $U_1$=674.1 V ($U_2$, U3 as in Table 2a) a resolution parameter R(+/−1 mm)>200,000 is obtained.

Starting from the configuration for first and second order focusing, that was determined according to the method described by the invention, even higher values of the parameter R can be found by adjusting one or all of the potential differences $U_1$, $U_2$, or $U_4$. FIG. 2*c* shows that the plot of the relative flight times takes on the shape of a slightly curved S. If e.g. $U_1$ is adjusted to 674.1 V the value of R(+/−1 mm) is found to be in excess of 200,000.

Post Acceleration

A post acceleration stage between electrodes 30 and 31 is shown in the preferred embodiment of a TOF-MS diagrammed in FIG. 1 and its contribution to the flight time was included in Equation (1). Taking the dimensions $d_1$ through $d_5$ and $\gamma$ as input constants one finds two conditions for the independent variables $\alpha'$ and $\rho$ from the modified Equations (2). Following the procedure that lead to Equation (3) results in a modified condition for the variable $\alpha'$, again substituting $x=(1/\alpha')^{1/2}$.

$$G(x)=ax^7+bx^5+cx^3+d'x^2+e'=0 \tag{4a}$$

where: (4b)

$a=-fd_1$ $b=2fd_1+d_2$ $c=-(fd_1+d_2)$ $d'=d_3+d_5/\gamma[(1+\gamma)^{-1/2}-(1+\gamma)^{-3/2}]$ $e'=-d'$ A solution of condition 4*a* is again found by means of know numerical algorithms. Hence, simultaneous longitudinal focusing of first and second order is possible for a TOF-MS according to the invention that includes an additional post acceleration stage in front of the detector.

Orthogonal Injection of a Divergent Beam

In any real instrument, the initial orthogonal beam will not be strictly a parallel stream of ions, all moving in the direction of axis 44 (FIG. 1) and having no velocity component perpendicular to that direction, i.e. in the direction of axis 45. The situation is more adequately represented by a stream of ions diverging from a point source 55 as shown in FIG. 3, which is located on axis 44 a distance $I_f$ from reference point 54 in the center of the ion packet 9 under consideration in first stage 48 of the accelerator. The point source may be a pinhole aperture or a real or virtual ion optical trajectory crossover. In the case that the ion beam transfer is facilitated by a system of ion optical lenses the length $I_f$ must be extrapolated backwards from the angle of divergence and the width of orthogonal ion beam 8.

For reference a right-angled coordinate system is introduced, which has the origin at point 55, the positive z-axis as before parallel to the instrument acceleration axis 45 and towards electrode 12, the positive x-axis congruent to axis 44 in the direction of the initial beam, and the y-axis perpendicular to the z-x plane in a right-handed system. The x-y plane of that system at z=0 is located at distance $fd_1$ from electrode 12 and corresponds to a the position parameter k=1. Furthermore, from the definitions one has the relation $z=fd_1(1-k)$.

Now, at every position in that diverging stream of ions, the velocity component in z direction (parallel to axis 45 is uniquely related to the distance from the point source and the distance from the x-y plane. This case was previously analyzed by Laiko and Dodonov. In following their procedure, one has at x=0 in the z-y plane $v_z/v_i=z/I_f$ where $v_z=v_z(z)$ is the velocity in z direction and $v_i$ is the injection velocity in direction of axis 44. Then, the dimensionless velocity $\zeta=v_z/v_0=\zeta(k)$ in axial direction is introduced, which is a now function of the coordinate z, i.e. the position parameter k.

$$\zeta=\omega\cdot(1-k) \tag{5}$$

$$\omega=\sqrt{\frac{U_i}{U_0}}\cdot\frac{fd_1}{I_f}$$

With this definition, the flight time of an ion that starts from a position in the y-z plane through reference point 55 can be expressed as follows:

$$T(k,\zeta)=T(K,0)-p\cdot\zeta \tag{6}$$

$$K=\frac{\zeta^2}{\alpha'}+k;\quad p=\frac{1}{v_0}\cdot\frac{2fd_1}{\alpha'}$$

The flight time is now a function of k and $\zeta$, or K and $\zeta$, where $\zeta$ in turn is a function of k. As before, the conditions for first and second order longitudinal focusing require, that the derivatives of the flight time with respect to k vanish for k=1;

$$\frac{\partial T(k,\zeta)}{\partial k}=\frac{\partial T(K,0)}{\partial K}\cdot\frac{\partial K}{\partial k}-p\cdot\frac{\partial\zeta}{\partial k}=0;\quad k=1 \tag{7a}$$

$$\frac{\partial^2 T(k,\zeta)}{\partial k^2}=\frac{\partial^2 T(K,0)}{\partial K^2}\cdot\left(\frac{\partial K}{\partial k}\right)^2+\frac{\partial T(K,0)}{\partial k}\frac{\partial^2 K}{\partial k^2}-p\cdot\frac{\partial^2\zeta}{\partial k^2}=0;\quad k=1 \tag{7b}$$

Carrying out the differentials in the Equations 7a and 7b results in tm new differential conditions in the parameter K;

$$\frac{\partial T(K,0)}{\partial K}+p\cdot\omega=0;\quad K=1 \tag{8a}$$

$$\frac{\partial^2 T(K,0)}{\partial K^2}-\frac{2p\omega^3}{\alpha'}=0;\quad K=1 \tag{8b}$$

Note that the differential expressions in Equations (8a) and (8b) are simply in terms of T(K,0), with additional terms reflecting the initial velocity component in axial direction.

Returning to the scope of the present invention, it is now necessary to find the solution of Equations (8a) and (8b) for a TOF-MS with a two stage accelerator, drift spaces, single stage reflector, and an optional post acceleration stage. Following the procedures that led to equations (3) and (4), one finds a condition in the variable $x=(1/\alpha')^{1/2}$ which has to be satisfied in order to determine the electric potentials that yield first and second order focusing for a TOF-MS according to the invention;

$$H(x)=G(x)+2fd_1\omega(x^6-x^4)+8fd_1\omega^3(x^8-x^{10})=0 \tag{9}$$

G(x) is taken from Equation (4). As before, a solution of simultaneous equations (8a) and (8b) can be found numerically. Then, the potentials $\alpha'$, hence $\alpha$ and $\beta$, and $\rho$ are determined, that will result in first and second order focusing of ions from a diverging orthogonal beam that start their flight through the TOF-MS from the z-y reference plane which includes point 54.

It is easy to extend the scope of Equation (6) to ions in a divergent beam that start in the accelerator region 48 from different lateral positions in x direction. By modifying the parameter $I_f$ accordingly, the relative flight times can be calculated for ions starting within a range of x, z coordinates. The definition of the resolution parameter R is readily extended to the to dimensional case;

$$R=\frac{T_0}{2\cdot\Delta T}=\frac{T_0}{2[\max(T(x,z))-\min(T(x,z))]};\quad |x|<\partial,\ |z|<\delta \tag{10}$$

A set of acceleration and reflection potentials was determined for an orthogonal injection TOF-MS with the dimensions given in Table 1 and which includes a post acceleration stage where $d_5$=10 mm and $U_5$=10,000 V. The distance $I_f$ from point source 55 of the orthogonal diverging beam from to point 54 was set to 115 mm. Sensitive boundaries −1 mm<z<+1 mm, −10 mm<x<+10 mm for the resolution parameter R, correspond to a full angle of divergence of 1 degree. The results are summarized in Table 3, column a. First and second order focusing is achieved for ions starting from the reference plane through point 54 located at x=0.

Figure 4:
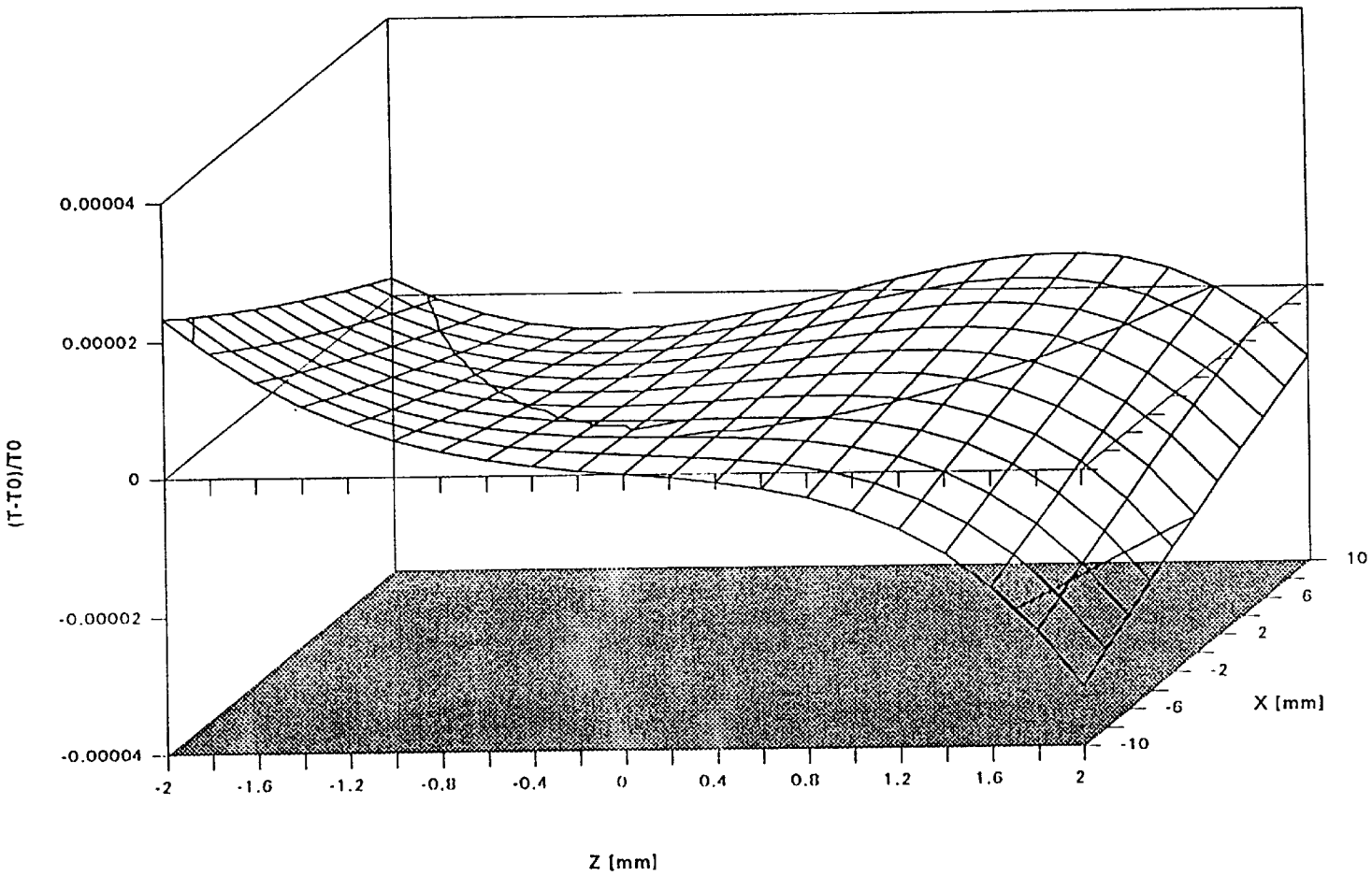
FIG. 4: Relative flight times as a function of the starting position coordinates x and z for the optimized TOF-MS with orthogonal injection of a divergent ion beam. For sensitive boundaries |z|<1 mm and |x|<10 mm a resolution parameter R=46436 is found from the distribution of flight times.

On the basis of the solution that was determined according to procedures described by this invention, the resolution parameter R in the boundaries relevant to the design of the instrument under consideration can be further optimized by adjusting one or all of the potential differences $U_1$, $U_2$, or $U_4$. The parameters of such an optimized orthogonal injection TOF-MS are summarized in Table 3 column b. FIG. 4 shows the calculated flight times as a function of the coordinates x and z for the optimized TOF-MS parameters listed in Table 3, column b.

TABLE 3

Parameters of a TOF-MS according to the invention with orthogonal injection of a divergent ion beam;
a) first and second order longitudinal focus for ions starting form the z-y plane;
b) TOF-MS with optimized resolution parameter, R.

| Parameters | a) orthogonal TOF, first and second order focus of z-y plane | b) optimized orthogonal TOF (FIG. 4) | Units |
|---|---|---|---|
| $I_I$ | 115 | 115 | mm |
| $\phi$ | 1 | 1 | ° |
| $d_5$ | 10 | 10 | mm |
| $U_5$ | 10,000 | 10,000 | V |
| $U_1$ | 671.68 | 672.40 | V |
| $U_2$ | 2200.00 | 2200.00 | V |
| $U_4$ | 4167.10 | 4167.10 | V |
| $U_0$ | 2535.84 | 2536.20 | V |
| $L_{eq}$ | 1041.9 | 1041.9 | mm |
| $T_0$ (m/z = 560) | 35.22 | 35.22 | μs |
| p | 61 | 61 | % |
| $L_{WM}$ | 230.64 | 230.25 | mm |
| R (+/− 1, +/− 10 mm) | 29943 | 46436 | |

Thus, in summary, a Time-of-Flight mass spectrometer has been described that comprises a two stage ion accelerator, a single stage ion reflector, first and second drift spaces and, optionally, post acceleration. According to the invention the instrument achieves longitudinal focusing of first and second order, when electric potentials are applied whose magnitude is predetermined for a given geometrical setup by solving the equations described. As a result, the quality of longitudinal focusing is higher than in conventional TOF-MS, while the number of passages through mesh electrodes is reduced. Hence, both mass resolution and instrument sensitivity are improved. Longitudinal focusing of first and second order can be achieved also in the case that a post acceleration stage is added to the TOF-MS. The invention includes the means to achieve higher sensitivity and resolution in TOF-MS with improved first and second order longitudinal TOF focusing in the case where ions are injected into the accelerator of the TOF-MS in a divergent orthogonal beam. In this case higher values of the two dimensional resolution parameter can be obtained by adjusting the potentials around the values that were determined for first and second order focusing of ions which start from a reference plane. This further adjusting of the electrode potentials around the values calculated to achieve first and second order focusing, can yield higher resolution parameters for a given initial spatial distribution than the simultaneous focusing of first and second order itself.

Having described this invention with regard to specific embodiments, it is to be understood that the description is not meant as a limitation since further variations or modifications may be apparent or may suggest themselves to those skilled in the art. It is intended that the present application cover such variations and modifications as fall within the scope of the appended claims.

References Cited

The following references referred to above are hereby incorporated herein by reference:

| U.S. Patent Documents | | |
|---|---|---|
| 2,685,035 | July 27, 1954 | W. C. Wiley |
| 4,072,862. | | B. A. Mamyrin |
| Submitted to U.S. Patent Office (1996) | | E. E. Gulcicek |

Other References Cited

W. C. Wiley, I. H. McLaren, Rev. Sci. Inst. 26, 1150 (1955).

G. J. O'Halloran, R. A. Fluegge, J. F. Betts, W. L. Everett, Report No. ASD-TDR 62-644, Prepared under Contract AF 33(616)-8374 by The Bendix Corporation Research Laboratories Division, Southfield, Mich. (1964).

J. H. J. Dawson, M. Guilhaus, Rapid Commun. Mass Spectrom. 3, 155 (1989).

A. F. Dodonov, I. V. Chernushevich, V. V. Laiko, 12$^{th}$ Int. Mass Spectr. Conference, Amsterdam (1991);

O. A. Migorodskaya, A. A. Shevchenko, I. V. Chernushevich, A. F. Dodonov, A. I. Miroshnikov, Anal. Chem. 66, 99 (1994).

A. N. Verentchikov, W. Ens, K. G. Standing, Anal. Chem. 66, 126 (1994).

V. V. Laiko, A. F. Dodonov, Rapid Communications in Mass Spectrometry 8, 720 (1994).

V. I. Karataev, B. A. Mamyrin, D. V. Shmikk, Sov. Phys. Tech. Phys. 16, 1177 (1972);

B. A. Mamyrin, V. I. Karataev, D. V. Shmikk, V. A. Zagulin, Sov. Phys. JETP 37, 45 (1973).

T. Leisner, Thesis, University of Konstanz (1986).

T. Bergmann, T. P. Martin, H. Schaber, Rev. Sci. Inst. 60, 347 (1989).

What is claimed is:

1. A method for conducting mass analysis utilizing a Time-Of-Flight Mass spectrometer, which includes an ion source, an ion accelerator comprising more than one stage, a spatial distribution of ions located with said accelerator, a single stage ion reflector, first and second drift spaces, electrodes and a detector comprising a detector surface, said method comprising:

applying electrical potentials to the electrodes in the Time-of-Flight Mass spectrometer to compress said spatial distribution of ions in said accelerator and achieve simultaneous first and second order longitudinal focusing for ions of equal mass to charge value arriving at the detector surface, wherein said electrical potentials are determined based on the dimensions of the Time-of-Flight Mass spectrometer.

2. A method as claimed in claim 1, wherein the Time-Of-Flight mass spectrometer is an orthogonal pulsing Time-Of-Flight mass spectrometer.

3. A method as claimed in claim 1, wherein said ion accelerator is a two stage ion accelerator.

4. A method as claimed in claim 1, wherein the Time-Of-Flight mass spectrometer further includes a post-acceleration stage.

5. A method for conducting mass analysis with a Time-of-Flight Mass spectrometer comprising:

providing a Time-Of-Flight mass spectrometer comprising a single stage ion reflector and a detector comprising a detector surface; and, conducting first and second order longitudinal focusing of ions of equal mass to charge value onto the detector surface in said Time-Of-Flight mass spectrometer.

6. A method as claimed in claim 5, wherein the Time-Of-Flight mass spectrometer is an orthogonal pulsing Time-Of-Flight mass spectrometer.

* * * * *